US011377913B2

(12) United States Patent
McBeath

(10) Patent No.: US 11,377,913 B2
(45) **Date of Patent: *Jul. 5, 2022**

(54) OFFSHORE DRILLING RIG COMPRISING AN ANTI-RECOIL SYSTEM

(71) Applicant: MAERSK DRILLING A/S, Kgs. Lyngby (DK)

(72) Inventor: William James McBeath, Copenhagen V (DK)

(73) Assignee: MAERSK DRILLING A/S, Lyngby (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/989,181

(22) Filed: Aug. 10, 2020

(65) Prior Publication Data

US 2020/0370377 A1 Nov. 26, 2020

Related U.S. Application Data

(63) Continuation of application No. 15/772,056, filed as application No. PCT/DK2016/000039 on Oct. 28, 2016, now Pat. No. 10,738,543.

(30) Foreign Application Priority Data

Oct. 28, 2015 (DK) ..... PA 2015 00664

(51) Int. Cl.
*E21B 19/00* (2006.01)
*E21B 19/02* (2006.01)

(52) U.S. Cl.
CPC ..... *E21B 19/006* (2013.01); *E21B 19/002* (2013.01); *E21B 19/008* (2013.01); *E21B 19/02* (2013.01)

(58) Field of Classification Search
CPC .... E21B 19/002; E21B 19/006; E21B 19/008; E21B 19/02
See application file for complete search history.

(56) References Cited

U.S. PATENT DOCUMENTS 4,351,261 A 9/1982 Shanks
4,432,420 A 2/1984 Gregory et al.
(Continued)

FOREIGN PATENT DOCUMENTS

GB 2104128 3/1983
WO WO 2001081164 11/2001
(Continued)

OTHER PUBLICATIONS

Danish Application No. PA 2015 00664 Search Report dated Jul. 14, 2016, 4 pages.
(Continued)

*Primary Examiner* — James G Sayre
(74) *Attorney, Agent, or Firm* — Lathrop GPM LLP

(57) ABSTRACT

Disclosed herein are embodiments of an offshore drilling rig comprising: a drill floor (107) defining a well center (123); a hoisting system configured to advance a tubular string (128) downwards through the well center (123) and to the seafloor (124) and to apply a lifting force to a tubular string (128) extending through the well center (123) and to the seafloor (124), the lifting force being large enough to support at least a major part of an apparent weight of the tubular string (128); and an anti-recoil system (218) configured to cause, in case of a sudden reduction of a load suspended from the drilling rig, the hoisting system to raise the tubular string (128) while preventing damage to the hoisting system.

21 Claims, 8 Drawing Sheets

(56) References Cited

U.S. PATENT DOCUMENTS

| | | | | |
|---|---|---|---|---|
| 4,759,256 | A | 7/1988 | Kovit et al. | |
| 8,157,013 | B1 | 4/2012 | Trent | |
| 8,297,359 | B2 | 10/2012 | McKay et al. | |
| 9,784,051 | B2 * | 10/2017 | Bergan | E21B 19/006 |
| 10,738,543 | B2 * | 8/2020 | McBeath | E21B 19/002 |
| 2014/0010596 | A1 | 1/2014 | Wu et al. | |
| 2014/0331908 | A1 * | 11/2014 | Plain | E21B 19/09 114/122 |
| 2015/0184470 | A1 | 7/2015 | Megens et al. | |

FOREIGN PATENT DOCUMENTS

| | | |
|---|---|---|
| WO | WO 2014108541 | 7/2014 |
| WO | WO 2017071708 | 5/2017 |

OTHER PUBLICATIONS

PCT/DK2016/000039 International Search Report and Written Opinion dated Oct. 2, 2017, 10 pages.

* cited by examiner

OFFSHORE DRILLING RIG COMPRISING AN ANTI-RECOIL SYSTEM

CROSS REFERENCE TO RELATED APPLICATIONS

The present application is continuation of U.S. patent application Ser. No. 15/772,056 with a § 371 (c) date of 28 Apr. 2018, which is a 35 U.S.C. § 371 filing of International Application No. PCT/DK2016/000039, filed 28 Oct. 2016, which claims priority to Danish Patent Application No. PA 2015 00664 filed 28 Oct. 2015, the entire contents of which are incorporated herein by reference.

TECHNICAL FIELD

The invention generally relates to a drilling rig and to an offshore drilling vessel, such as a drillship or a semi-submersible, including such a drilling rig.

BACKGROUND

Offshore drilling vessels are widely used for the exploration and exploitation of hydrocarbon reservoirs under the sea floor. One type of drilling vessel structure is a drillship, e.g. as described in WO 2014/108541.

It is generally desirable to provide an offshore drilling vessel that allows for an efficient and flexible operation. It is further generally desirable to provide an offshore drilling vessel that facilitates operation with a high degree of safety. It is further generally desirable to provide drilling vessels that can perform drilling operations at large depths.

The tasks performed by such drilling rigs often include well completion and intervention operations where subsea trees are installed. Examples of such tasks include well completion, flow testing, well stimulation, well workover, diagnostic well work, bullheading operations, plugging wells and/or abandoning wells.

During such operations, a Completion Work-Over Riser (CWOR) system is typically used if a vertical xmas tree is utilized. Such as system comprises a subsea tree that is installed on the seafloor and connected to the well head and a string of completion riser joints spanning between the subsea tree and the drilling vessel. The completion riser typically has an outer diameter of about 8-14". The CWOR is typically connected to a surface flow tree on the drill floor where hydrocarbons from can be received. The completion riser string is typically suspended from the drilling vessel both by a riser tensioner system that is installed under the drill floor of the vessel and the hoisting system in a shared load configuration. The riser tensioner system typically carries the majority of the load of the completion riser string and maintains suitable tension. The hoisting system of the drilling rig typically carries a minor portion of the load of the completion riser. The riser tensioner assembly typically comprises a number of hydraulic cylinders and/or wires whose one end is connected to the support structure of the vessel and whose other end is connected to a riser tension ring through which the completion riser extends and in which the completion riser can be hung off.

During control and intervention operations, situations may arise where the completion riser string needs to be rapidly disconnected from the subsea tree. To this end, subsea trees typically comprise an emergency disconnect mechanism.

For example, U.S. Pat. No. 8,297,359 discloses a completion work-over riser system where the subsea tree is connected to a lower riser package (LRP) and an emergency disconnect package (EDC) between the CWOR and the tree. The LRP and EDC together implement an emergency disconnect functionality. The emergency disconnect package is installed on top of the lower riser package and, during an emergency disconnect operation, the connection between the emergency disconnect package and the lower riser package is disconnected. Hence, the completion riser string with the emergency disconnect package attached to its bottom end are disconnected from the lower riser package and, thus from the remaining parts of the subsea tree and from the well head.

As an alternative a so-called horizontal xmas tree may be used. In such cases completion and work over operation are typically performed by installing a blow-out-preventer (BOP) and a marine riser between the drilling rig and the xmas tree. The riser tensioners will in this case tension the marine riser whereas the hoisting system supports a high pressure conduit (such as a high pressure casing or high pressure riser) connected to the surface flow tree. The high pressure conduit typically has an outer diameter of about 8-14". This conduit is connected to a subsea test tree installed inside the assembly typically mainly in the lower BOP stack. In the event of an emergency disconnect, the rams of the BOP will typically be used to seal the well and the lower-marine-riser package of the BOP will be disconnected from the lower stack thereby disconnecting the riser and the high pressure conduit. Subsea test trees typically have a shear-able component which is to aligned with a shearing ram of the lower stack of the BOP. This shearing ram is used to shear the subsea test tree in case of an emergency thus releasing the high pressure conduit from what is typically the main part of the tree below the shear-able component.

In the following the term high pressure (HP) tubular string will be used as a common term for a completion riser as used for vertical xmas trees or a high pressure conduit as used with horizontal xmas trees.

As part of the emergency disconnect procedures tubulars and/or components may be sheared below the point of disconnect of the subsea components, i.e. typically below the EDS in case of a vertical xmas tree and below disconnect point of the LMRP in case of a horizontal tree. In order to avoid that lateral movement of these stumps below the point of disconnect at the time of disconnect (e.g. stumps protruding into the LRP or lower stack when disconnecting the EDP or LMPR, respectively) damages the subsea equipment (e.g. LRP or lower stack of the BOP), it is desirable to lift the disconnected HP tubular string sufficiently so as to allow these stumps to free from the subsea equipment remaining on the seabed. At the same time it is desirable to prevent an uncontrolled upwards recoil of the suddenly disconnected HP tubular string. To this end, the riser tensioner system may be provided with an anti-recoil valve which is configured, in the event of an emergency disconnect, to cause the hydraulic cylinders of the riser tensioner system to pull up the riser tension ring and, thus, the completion riser string or marine riser, by a certain amount in a controlled fashion while preventing an uncontrolled upwards recoil, as this may otherwise damage on-board equipment or structures. For example, U.S. Pat. No. 8,157,013 discloses an example of a tensioner system with recoil control.

However, the above anti-recoil arrangement has a number of disadvantages:

Firstly, the above arrangement does not provide sufficient re-coil protection to the parts of the hoisting system, e.g. a top drive, that carry the load of the upper portion of the riser string which extends upwards from the riser tension ring. To this end, an additional riser tension frame may have to be installed above the drill floor and below the top drive or hook of the hoisting system. For example, US 2014/0331908 discloses a tension frame including an anti-recoil valve. However, this solution increases the complexity of the system. It would thus be desirable to provide a less complex system.

Secondly, the riser tensioner system is typically dimensioned such that it can support the weight and outer dimensions of a marine riser string that is used during the drilling stage. As the completion riser string is usually considerably smaller and lighter, the over-dimensioned riser tensioner system may induce undesired stress in the subsea equipment and/or may require adaptation when used with a completion riser string. As the hydraulic cylinders of the riser tensioner system are typically symmetrically arranged to evenly support the load carried by the riser tension ring, it is normally not desirable to disconnect individual cylinders, as this would cause a less symmetric distribution of forces. Thirdly, the compensating tension frame will often have to work in unison with the riser tensioners which requires installation and testing. Fourthly, the controls for the compensating tension frame are typically separate controls from the controls for the riser tensioners which typically are controlled by the driller which in turn may be a source of discoordination. Finally, limited lifting height of the rig may pose a problem for some drilling rigs in application of a compensating tension frame as the frame must be lifted to allow sufficient room to stroke out in case of higher waves or a drift off from position. In some instances the surface flow tree mounted at the end of the HP tubular string also requires added height of the frame which tend to increase as pressure and temperature in the well increases.

It would thus be desirable to provide a system that is more easily scalable, simple and/or safe.

SUMMARY

Disclosed herein are embodiments of an offshore drilling rig comprising:

- a drill floor defining a well center;
- a hoisting system configured to advance a tubular string downwards through the well center and to the seafloor and to apply a lifting force to a tubular string extending through the well center and to the seafloor,
- an anti-recoil system configured to cause, in case of a sudden reduction of a load suspended from the drilling rig, the hoisting system to raise the tubular string while preventing damage to the hoisting system.

Hence, in embodiments of the drilling rig disclosed herein, the anti-recoil system is integrated within the hoisting systems passive compensating system, thus avoiding the need for utilizing separate anti-recoil functionalities in a tension frame above the drill floor. In cases were the tubular string is a CWOR connected to a vertical xmas tree or a high pressure conduit connected to a subsea test tree, the potential omission of a compensated tension frame may provide several advantages such as reduced rig up and rig down time of equipment, reduce cost and/or increase safety due to a simplified control system due to omission of some or all of the implication of using a compensating tension frame discussed above.

In some embodiments, the lifting force being large enough to support at least at least a majority part of an apparent weight of the tubular string. In the case of a CWOR setup the application of (marine) riser tensioners to support part of the load of a CWOR may be reduced or preferably avoided by letting the hoisting system substantial provide the required load of the string. This may increase safety and/or reduce cost due to a simplified control system where anti recoil is sufficiently applied from a single position.

Supporting the apparent weight may be understood as providing the necessary upwards force or pull to the tubular string to operate the tubular string for completion or work over operations. Typically, all components above the point of disconnect in an emergency disconnect are placed in tension or over pull. For a vertical xmas tree this means that the apparent weight of the string is the weight (taking buoyancy into account) of the CWOR and EDP including any fluids in the CWOR as well as sufficient over pull. For a horizontal xmas tree the marine riser is handled by the riser tensioning system independently of the hoisting system, so the apparent weight of the string is the weight (taking buoyancy into account) of the high pressure conduit and the part of the subsea test tree above the shear-able component as well as sufficient over pull. In some embodiment a sufficient over pull is 10 tons or more, such as 20 tons or more, such as 30 tons or more, such as 40 tons or more. In some embodiment the apparent weight is at least 100 tons, such as at least 200 tons, such as 300 tons, such as 400 tons, such as at least 500 tons, such as at least 600 tons, such as at least 700 tons, such as at least 800 tons such as at least 1000 tons. In some embodiments, the apparent weight supported by the hoisting system alone or in combination with riser tensioners may be more than the weight of the CWOR string or the hp conduit at least minus any buoyance, such as 110% of that weight or more, such as 120% or more, such as 150% or more, such as 200% or more, such as 300% or more, such as 400% or more, such as 500% or more.

Hence, when the load suspended from the hoisting system of embodiments of the drilling rig disclosed herein is suddenly reduced—e.g. due to an emergency disconnect where the pipe is cut—the hoisting system of the drilling rig provides a lift that is sufficient to clear any pipes, components, hp tubulars and/or completion risers out of and from subsea equipment remaining at the sea floor after the disconnect while preventing damage to the hoisting system e.g. due to a hydraulic lifting cylinder stroking out with force. After a sufficient lift has been provided it is preferable if the hoisting system ramps down the lifting rather than stopping abruptly to avoid pendulum effects in the connected load. In embodiments of the drilling rig disclosed herein, the lifting-response is thus built into the primary hoisting system itself, i.e. a hoisting system configured to advance a drill string through the well center and to the sea floor. Embodiments of the anti-recoil system cause the hoisting system to raise the tubular string in a controlled fashion while preventing an uncontrolled upwards recoil. Such an uncontrolled upwards recoil might otherwise cause cylinders of the hoisting system to bottoming out and/or cause damage that may occur due to the assembly being pulled up too quickly and therefore inducing a yo-yo effect and the subsequent load generated by this. Hence, the anti-recoil system may be configured to control, e.g. limit, the speed by which the tubular string is raised. Alternatively or additionally, the anti-recoil system may be configured to control, e.g. limit, the height by which the tubular string is raised, e.g. to a maximum height smaller than a maximum strike length of a cylinder of the hoisting system.

Furthermore, embodiments of the drilling rig disclosed herein provide a scalable system as many hoisting systems are capable of being configured to handle different load ranges. For example, hydraulic hoisting systems typically comprise a plurality of cylinders which can selectively be brought into an operational state and a passive/decoupled state, such that the lifting capacity of the hoisting system can be adapted to desired values. Another configuration is a passive compensator which has selectable amounts of APV's/NPV's whereby the load and accuracy of the system can be adjusted.

The term drill floor normally refers to a work area in immediate proximity of the well center; it is the primary work location for the rig crew and/or machines performing similar functions, such as iron roughnecks. The drill floor normally comprises a rotary table defining the well center. The drill floor is typically located on the lowest deck above the diverter system. Diverter systems for offshore drilling vessels are typically provided beneath the drilling rig rotary table. Such a diverter system provides a vent line and ensures that flow from a tubular string may be directed away from the drilling rig. Hence, in some embodiments, the offshore drilling vessel comprises a diverter system under the well center.

The term well center refers to a hole in the drill floor through which the drilling rig is configured to lower tubulars towards the seabed and, in particular, through which tubulars may be lowered all the way to the seabed. A well center is sometimes also referred to as a drilling center. It will be appreciated that the drilling rig may comprise multiple well centers and/or additional holes, e.g. foxholes and mouse-holes that may e.g. be used for building stands of tubulars but through which the drilling rig cannot lower tubulars to the seabed and/or through which the drilling rig cannot perform drilling into the seabed e.g. by lacking a system arranged to rotate a drill string with sufficient force such as a top-drive or a rotary table. In some embodiments, such an additional hole is a hole in the drill floor deck through which the drilling rig cannot progress a drill string through a riser system. In some embodiments, a well center is differentiated from an additional hole by having a diverter and/or a diverter housing arranged below so that drill string passed through the well center extends through said diverter or diverter housing. In some embodiments, the drilling rig is a dual (or even multiple) activity rig where more than one main or auxiliary drilling operations may be performed through two or even more separate well centers.

The hoisting system is configured to raise or lower tubulars through a well center in the drill floor. Examples of hoisting systems include draw-works hoisting systems and hydraulic hoisting systems.

The drilling vessel may further comprise one or more top-drives and/or other equipment for imparting torque on a drill string. Typically, the hoisting system comprises a top drive operable to impart a torque on the tubular string, e.g. during drilling operations. The top drive is movably arranged above the drill floor operable to be moved up and down while advancing a tubular string. To this end, the top drive may be movably attached to a drilling support structure such as a derrick, a mast or the like, e.g. via a guide dolly. The top drive may be arranged to be raised and lowered by the hoisting system. An upper end of the tubular string may be connected to the top drive so as to allow the top drive to impart a torque on the tubular string and/or so as to allow a fluid connection to be established between the tubular string and a hose, pipe or other tubular connector of the top drive. In some embodiments, the anti-recoil system is configured to control a lifting force acting above the top drive or even above the hook, i.e. a lifting force that raises the top drive and/or hook and the tubular string. In this way the hook and/or top drive may be in direct mechanical connection to a CWOR or a high pressure conduit during a completion or work over process while hydrocarbons are flowing to the surface. Direct mechanical connection is understood to be a mechanical connection with a substantial direct transfer of forces as opposed a setup with compensating cylinders or other flexible connectors as part of the connection.

In some embodiments, the hoisting system is a hydraulic hoisting system comprising one or more hydraulic hoisting cylinders configured to provide a lifting force. In particular, a hydraulic hoisting system may comprise two spaced-apart sets of hoisting cylinders, each set comprising one or more cylinders. The cylinders are sometimes also referred to as rams. The hoisting lines may be parallel, fixed length, wires with one end anchored at a suitable support structure e.g. at the drill floor; this end is also referred to as the dead end or the dead line and the anchor point is referred to as the deadline anchor. The other end of the hoisting lines carries the top drive and/or guide dolly and any load suspended by the hoisting system, e.g. a tubular string suspended below the top drive and may be referred to as the hoisting end or hook end. In This end of the hoisting lines may be connected to a hook, a travelling yoke or another suitable load carrier or directly to the top drive. The hoisting lines are run over one or more movably arranged sheaves, e.g. yoke sheaves that transform the push from the hoisting cylinders to an upward lifting force to the guide dolly and/or the top drive and to the suspended load. In some embodiment a travelling block may be applied rather than a direct run of the hoisting line. In some embodiments, the anti-recoil system is configured to control fluid flow between said hoisting cylinders and a fluid reservoir.

In some embodiments, the hoisting system is a draw works hoisting system. A draw works supply the power for lifting by turning the draw works drum on which the hoisting line is wound and controls the braking of the drum when loads (such as a drill string, a BOP, or a casing string) are lowered towards the seabed. The hoisting line runs to a crown block which is the stationary section of a block and tackle that contains a set of pulleys or sheaves through which the hoisting line is threaded or reeved and is opposite and above the traveling block. For a draw works hoisting system the load carrier is suspended by or a part of the travelling block. Note that regardless of shape the connection to the hoisting line or travelling block this connection is often referred to as the hook. In some embodiments the draw works hoisting system comprises a crown compensator (or top mounted compensator) formed by a crown compensator assembly and its controls. In some embodiments the assembly comprises one or more crown compensating hydraulic cylinders which are applied to raise or lower the crown block and thereby provide heave compensation. In some embodiments, an anti-recoil function is implemented into the hoisting system via the crown compensator e.g. in some embodiment the anti-recoil system is operationally connected to said one or more crown compensating hydraulic cylinders. Similar to the hydraulic lifting system, some embodiments of the anti-recoil system comprises an anti-recoil valve and a fluid reservoir fluidly connected via said anti-recoil valve to the one or more crown compensating hydraulic cylinders. Other types of systems for providing the anti-recoil function above the hook may also be suitable such as a hydraulic compensator on the deadline or similar. It is preferably a hydraulic function as such functions are typically less sensitive to black outs due to the stored hydraulic energy but an electrically implemented anti-recoil function e.g. in the control system for the hoisting system may be suitable.

In some embodiments the crown compensator has a mode of operation where the crown compensating hydraulic cylinders are locked or stroked in (sometimes referred to "on the beam") and thereby allow the crown block to carry a higher load than the compensator is rated for when it performs heave compensation. In some embodiments it is preferable that the entire apparent weight (or tension) of the tubular string is provided by the hoisting system and thus carried by the crown block. This may require enhancement of the load capacity of the crown compensator. In some embodiments the load rating of the crown compensator (i.e. the allowable load on the hook) in active heave compensating mode is 500 tons or more, such as 700 tons or more, such as 800 tons or more, such as 900 tons or more, such as 1000 tons or more, such as 1200 tons or more. In some embodiment the load rating of the crown compensator in active heave compensating mode is equal to that the load rating of the crown block.

The load requirement typically increase with water depth, so that in some embodiments, the apparent weight is for completion or work over operation in a water depth of 500 meters or more, such as 1000 meters or more, such as 1500 meters or more, such as 2000 meters or more, such as 2500 meters or more, such as 3000 meters or more.

Throughout this application the hoisting system is a hoisting system that is part of the drilling capability of the drilling rig through a well center i.e. for lowering drill string to the seabed and drilling wells for hydrocarbons. If the drilling rig comprises more than one drilling station (e.g. an main and auxiliary well center) the hoisting system is in some embodiment the hoisting system for drilling and constructing wells through the main well center and in some embodiments for the drilling top holes in the auxiliary well center.

In some embodiments, the hoisting system comprises a heave compensating system. The heave compensation system may be an active heave compensation system, a passive heave compensation system or a combination thereof. The anti-recoil system may be integrated into said passive heave compensation system. In some embodiments the heave compensation system utilizes the hoisting cylinders of the hydraulic hoisting system. In other embodiments, the dead end of the hoisting line is connected to a support structure of the drilling rig via one or more additional heave-compensating hydraulic cylinders different from the main hoisting cylinders of the hydraulic hoisting system. In such an embodiment, the anti-recoil system may operationally be connected to said one or more heave-compensating hydraulic cylinders. In yet further embodiments, a heave compensating system may utilize the main hoisting cylinders and separate heave-compensating cylinders. Accordingly, in some embodiments, the anti-recoil system comprises an anti-recoil valve and a fluid reservoir fluidly connected via said anti-recoil valve to the one or more hoisting cylinders and/or the one or more heave-compensating hydraulic cylinders.

An anti-recoil valve may be a valve having an open state and a reduced-flow or throttled state. When in the reduced-flow or throttled state, the flow through the anti-recoil valve is smaller than the flow permitted in the open state. The anti-recoil valve is operable to close in a controlled manner whereby the compensating system will stroke fully open or closed, depending on configuration, rather than locking immediately once reduced weight is registered. When in the open state, the main flow path is open. When activated, the anti-recoil valve may rapidly shut-off the main flow path, e.g. by means of a conventional shut-off valve while leaving the bypass flow path open. Alternatively, the anti-recoil valve may define a main flow path. When activated, the anti-recoil valve may provide an incomplete closure of the main flow path, thus leaving a reduced or throttled residual flow path.

Hence, when an anti-recoil valve is located between a fluid reservoir and a hydraulic cylinder of a hoisting system that carries a load and when the anti-recoil valve is activated in response to a sudden loss of the load, the cylinder may extend or retract in a controlled fashion, e.g. until the end of the stroke is reached, until the fluid flow to/from the cylinder is shut off by a control valve or shut-off valve or until a new equilibrium is reached. In some embodiments the anti-recoil system is configured to control the hoisting system to lift the HP tubular string by a predetermined minimum height while preventing uncontrolled upwards recoil of the HP tubular string. In some embodiments, the predetermined height is between 1 m and 15 m, such as between 1 m and 10 m, such as between 2 m and 5 m, such as between 3 m and 4 m. The anti-recoil system may be configured such that the lifting of the tubular string in controlled such that lifting speed does not exceed a predetermined threshold. In some embodiments the anti-recoil system is configured to control the hoisting system to lift the HP tubular string by at least a minimum height while preventing uncontrolled upwards recoil of the top drive or hook of the hoisting system. In some embodiments, the minimum height is between 1 m and 15 m, such as between 1 m and 10 m, such as between 2 m and 5 m, such as between 3 m and 4 m. In some embodiments the anti-recoil system is configured to obtain the predetermined minimum height at a first speed and then continue lifting e.g. to the maximum height of the hook at a second speed lower than the first speed. In some embodiments the first speed is more than 2 times higher than the second speed, such as more than 3 times, such as more than 5 times, such as more than 10 times faster.

In some embodiments, the anti-recoil system is configured to:

detect the stroke position of a cylinder—e.g. a main lifting cylinder of the hoisting system or a cylinder of a heave compensating system—, and to—allow the cylinder piston to move while increasingly restrict the cylinder in stroking out towards the end stop.

During normal operation, the length of the riser system may be adjusted so that the cylinder is placed close to mid-stroke to ensure that heave compensation can be performed. Such an anti-recoil system may thus comprise a control unit configured to detect the stroke position and to control anti-recoil valve. The electronics may be protected by a UPS.

By comparison, a flow-stop valve closes almost immediately. Such valves are typically used in riser tensioner cylinders where several cylinders hold the riser. If a cable connecting cylinder and riser breaks the cable could cause significant damage and, in particular if the cylinder is allowed to stroke out violently, this could also risk damage to the cylinder.

In some embodiments, the anti-recoil system may use a gradual flow-stop valve where some kind of timing ensures that the cylinder strokes out a certain length. However, in some situations this may be less preferable because the sufficient and safe distance may depend on the heave position and how big the heave motions are. On the other hand, such a system may be easy to make as a purely mechanical solution without the need for electronics and power.

In some embodiments, the anti-recoil system is configured to allow a cylinder to stroke out at least 30% of its maximum stroke length, such as at least 50%, such as at least 70%, such as at least 90%. To prevent the cylinder from being damaged, the anti-recoil system may be configured to allow a cylinder to stroke no more than 95% of its maximum stroke length, such as no more than 90%, such as no more than 80%.

Without an anti-recoil system, a sudden reduction of the suspended load, e.g. due to an emergency disconnect, would cause a sudden upwards movement of the tubular string suspended from the hoisting system and, where applicable, of the top drive. Without an anti-recoil system, the sudden reduction of the load would involve the hoisting system to pull the still suspended load upwards as the previously applied lifting force is suddenly too large to maintain the still suspended load stationary. This would thus cause the load-carrying parts of the hoisting system, any top drive, and the still suspended load to suddenly move upwards in an uncontrolled fashion. For the purpose of the present description, this sudden upwards movement is referred to as recoil.

In some embodiments, the anti-recoil system is configured to be selectively operable in an anti-recoil mode and an immediate shut-off mode; wherein the anti-recoil system is configured, when operated in the anti-recoil mode, to cause, in case of a sudden reduction of a load suspended from the drilling rig, the hoisting system to raise the tubular string while preventing uncontrolled upwards recoil of the tubular string; and when operated in the immediate shut-off mode, to cause, in case of a sudden reduction of a load suspended from the drilling rig, the hoisting system to substantially prevent any upwards recoil of the tubular string. Substantially preventing any upwards recoil may comprise limiting recoil to less than 1 m. To this end, the anti-recoil system may comprise a shut-off valve in addition to the anti-recoil valve. Alternatively, the anti-recoil valve may be configured to be operated in an anti-recoil mode and in an immediate shut-off mode. For example, in embodiments where the anti-recoil valve comprises a reduced bypass flow path, the anti-recoil valve may comprise an additional valve operable to close the reduced bypass flow path.

In some embodiments, the drilling rig is configured to perform well completion and/or intervention operations with a completion work-over riser system suspended from the hoisting system such that the hoisting system carries at least a majority of the apparent weight of the completion work-over riser system, such as at least 70% of the apparent weight, such as at least 80% of the apparent weight, such as at least 90% of the apparent, such as substantially the entire apparent weight of the completion riser string and of any subsea equipment connected to the completion riser string. It will be appreciated that the load suspended by the hoisting system may be the load caused by the apparent weight of the completion work-over riser system, i.e. the actual weight reduced by the portion of the actual weight resting on the sea floor.

In some embodiments, the drilling rig further comprises a recoil detection apparatus configured to detect a sudden decrease in the suspended load. For example, the recoil detection apparatus may comprise one or more sensors, e.g. a sensor for measuring the velocity of piston movements of the hoisting cylinders and/or the heave-compensating cylinders, a sensor measuring the load suspended from the hoisting system, a sensor measuring a pressure in the hoisting cylinders or heave-compensating cylinders, and/or the like. A sudden change in one or more of these detected parameters may thus be used as an indicator for a sudden decrease in load. For example, a piston velocity exceeding a predetermined threshold may be used as an indicator of a sudden reduction of the load. Similarly, a reduction of a measured load above a predetermined threshold within a predetermined period of time may be used as an indicator of a sudden reduction of the load. In some embodiments, the recoil detection system may receive a control signal from an emergency disconnect system, where the control system is indicative of the activation of the emergency disconnect system. In some embodiments, a sudden reduction in the load may be a reduction of the load by at least a predetermined threshold weight within a predetermined time interval. For example, the threshold weight may be 10% of the suspended load, e.g. 20%, e.g. 30%, e.g. 40%, e.g. 50% or even more. The time interval may depend on the characteristics of the shearing system used for an emergency disconnect. In some embodiments the time interval may be set to 500 ms, such as 100 ms or another suitable value.

As mentioned above, a completion work-over riser system may comprise a completion riser string, i.e. a string of completion riser joints that extend from the drilling vessel downwards to the sea floor. The completion work-over riser system may further comprise subsea equipment connected proximal to the lower end of the completion riser string. During operation, the subsea equipment may at least partially rest on the sea floor and be connected to a well head of the well that extends into the formation under the sea floor. The Subsea equipment may include a subsea tree connected at a lower end of a completion riser string. The subsea tree may be positioned on the seafloor and be connected to the well head of the well that extends into the formation under the seafloor. The subsea tree may include a device operable to disconnect the completion riser string from at least a bottom part of the subsea tree. In some embodiments, an uppermost part of the subsea tree may also be disconnected from the remaining bottom part of the subsea tree and remain connected to the lower end of the completion riser string. In particular, the subsea tree may comprise a lower riser package and an emergency disconnect package which together are operable to perform an emergency disconnect operation. During a disconnect operation, the emergency disconnect package may remain connected to the lower end of the disconnected completion riser string. For example, the lower riser package may function as a well barrier element while the emergency disconnect package provides quick disconnection of the riser, e.g. in case of vessel drift off/drive off or in case of other situations that may require a rapid disconnect. The subsea tree may comprise further components, such as a surface flow tree.

The offshore drilling rig may be implemented on an offshore drilling vessel such as a drillship, a semisubmersible or another form of drilling vessel. Generally, the vessel may be oblong having two ends—a bow and a stern. The vessel may comprise a hull and a vessel superstructure extending upwards above the hull. In some embodiments, the vessel comprises a midship portion between the ends. The hull of the vessel typically defines a main deck from which the moon pool extends downward. The vessel typically comprises a moon pool which defines an opening in the hull to the sea through which equipment may be lowered from the drill floor towards the seafloor so as to allow drilling operation into the seabed for accessing of hydrocarbon reservoirs. In particular, the moon pool typically extends downwards from the main deck of the vessel, and towards the body of water in which the vessel operates. The drilling rig may further comprise one or more drilling support structures such as a derrick, a mast and/or the like.

Embodiments of the drilling rig disclosed herein avoid the need for a riser tensioner system below the drill floor during the well completion and/or intervention operation when using a completion riser. Embodiments of the drilling rig disclosed herein avoid the need for modifying a riser tension ring (when using a completion riser) that is normally used for marine risers such that it becomes compatible with a completion riser string. In particular, the drilling rig may further comprise a riser tensioner system arranged under the drill floor, and a trip saver system operable to move the riser tensioner system between an operational position aligned with the well center and a parking position displaced from well center. The drilling rig may be operable to perform well completion and/or intervention operations with a completion riser string suspended from the hoisting system and with the riser tensioner system positioned in said parking position or with the riser tensioning system otherwise disconnected from the CWOR. Such as with in line riser tensioners or wireline riser tensioners disconnected from the CWOR. In the case of the setup with a horizontal xmas tree the riser tensioning system will typically be applied to provide tension to the marine riser hosting the high pressure conduit.

Embodiments of the drilling rig disclosed herein further reduce the required hook height that would otherwise be needed for the installation of a compensating tension frame below top drive.

The present disclosure relates to different aspects including the offshore drilling rig described above and in the following, further aspects of a drilling vessel and corresponding methods and/or products. Each aspect may yield one or more of the benefits and advantages described in connection with one or more of the other aspects, and each aspect may have one or more embodiments with all or just some of the features corresponding to the embodiments described in connection with one or more of the other aspects and/or disclosed in the appended claims.

In particular, disclosed herein are embodiments of a method of operating an offshore drilling rig, the drilling rig comprising a drill floor defining a well center, a hoisting system configured to raise and/or lower a tubular string through the well center; wherein the method comprises:

- suspending a high pressure tubular string from the hoisting system, the high pressure tubular string extending through the well center and downwards to the seafloor;
- detecting a sudden reduction of a load suspended from the hoisting system;
- controlling the hoisting system to raise high pressure tubular string while preventing damage to the hoisting system.

In some embodiments the method comprises suspending at least a majority part of the apparent weight of a completion work-over riser system from the hoisting system which have the advantages cited above.

In particular, embodiments of the method described herein may be used to operate embodiments of the offshore drilling rig disclosed herein.

In some embodiments, the hoisting system comprises one or more hydraulic cylinders and wherein controlling comprises controlling fluid flow between a fluid reservoir and the one or more hydraulic cylinders. In some embodiments the hoisting system is a draw works hoisting system comprising a crown compensator comprising one or more crown compensating hydraulic cylinders and controlling comprises controlling fluid flow between a fluid reservoir and the one or more crown compensating hydraulic cylinders.

BRIEF DESCRIPTION OF THE DRAWINGS

The above and/or additional objects, features and advantages of embodiments and aspects of the present invention, will be further elucidated by the following illustrative and non-limiting detailed description with reference to the appended drawings, wherein.

DETAILED DESCRIPTION

In the following description, reference is made to the accompanying figures, which show by way of illustration how the invention may be practiced.

Figure 1:
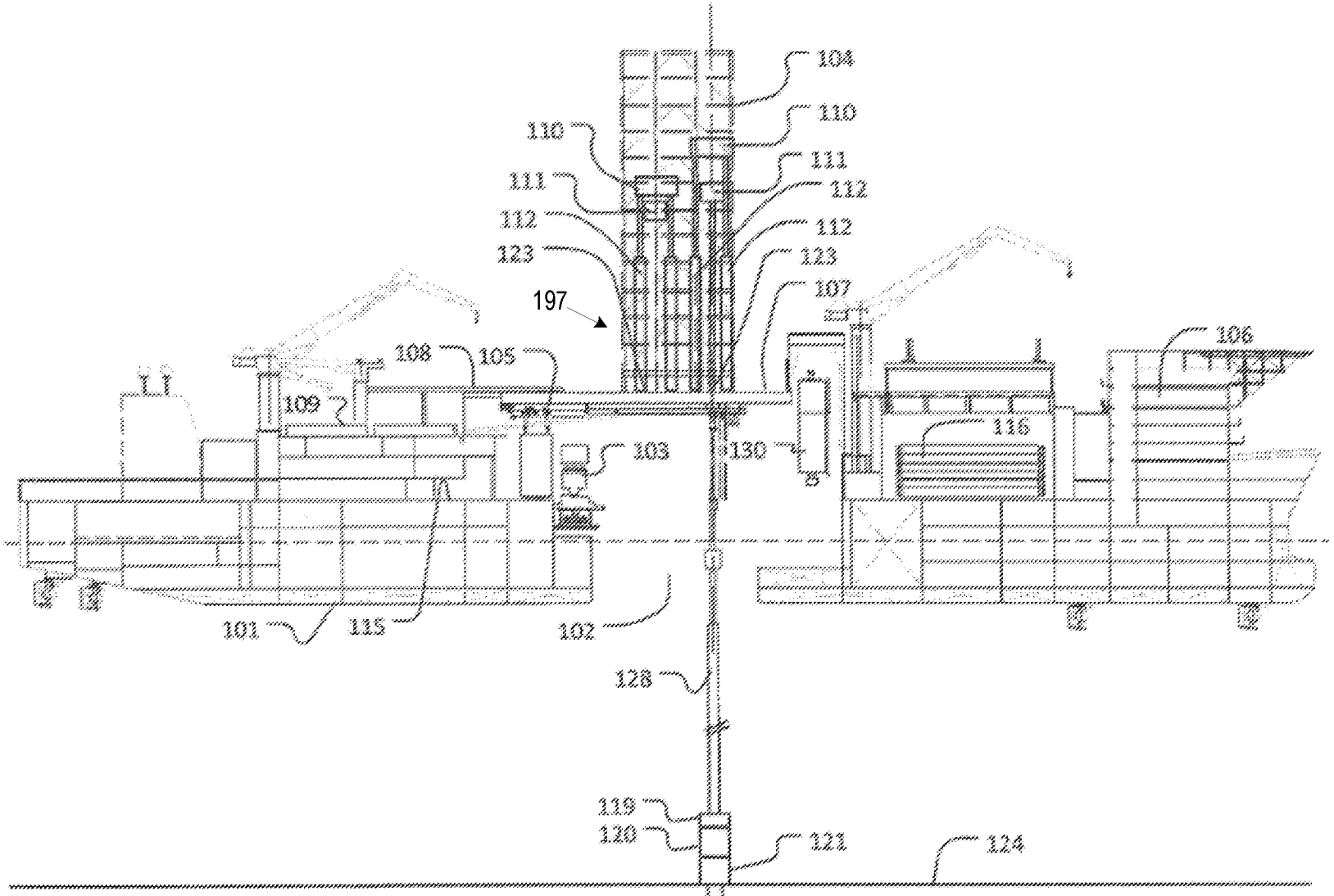
FIG. 1 illustrates an embodiment of an offshore drilling vessel.

FIG. 1 illustrates an embodiment of an offshore drilling vessel. The offshore drilling vessel of FIG. 1 is a drillship having a hull 101, a moon pool 102, a main deck 115, a drill floor deck 107, and superstructures 197 and 106 extending above the hull and above the main deck. The superstructure 197 is located in the midship portion of the vessel and it extends above the moon pool. Superstructure 197 serves as a substructure supporting the drill floor and a dual activity mast 104.

The drill floor deck 107 is located at a level above the main deck and it spans across the moon pool 102 that is formed in the hull of the drillship. The drill floor deck 107 comprises two holes defining respective well centers 123 located next to the dual activity mast 104. The dual activity mast 104 extends upwardly from the drill floor deck 107 and comprises two mast portions arranged side by side such that they are both located on the same side relative to the well centers. Each mast portion accommodates a hoisting system, each for lowering a drill string through a respective one of the well centers 123 and through the moon pool 102 towards the seabed. In the example of FIG. 1, the hoisting system is a hydraulic hoisting system comprising hydraulic hoisting cylinders 112 that extend upwardly relative to the drill floor deck 107 and that are arranged to raise and lower a yoke sheave 110 from which a top drive 111 is suspended. In alternative embodiments, other hoisting systems may be used, e.g. a draw-works system comprising a draw-works motor/drum which may be positioned at a suitable location on the drilling rig. Each well center is located next to one of the mast portions and the corresponding hoisting system. The side-by-side configuration of the dual activity mast and well centers allows for efficient dual operations, easy access to both well centers, and convenient visual control of both well centers from a single driller's cabin. However, other layouts of the well centers and drilling support structures are possible as well as are drilling vessels with only a single hoisting system and corresponding well center.

In the example of FIG. 1, a completion work-over riser system is suspended from one of the hoisting systems. The completion work-over riser system comprises a HP tubular string (in this case a completion riser string 128) that extends from the drilling vessel to the sea floor 124. The completion work-over riser system further comprises a subsea tree connected to the lower end of the completion riser string and to the well head of a well 122 that extends into the formation under the sea floor 124. The subsea xmas tree 121 is positioned on the sea floor and connected to an emergency disconnect package 119, a lower riser package 120. However it will be appreciated that other embodiments of subsea tree may comprise alternative and/or additional components.

The drilling vessel further comprises a number of additional components all known as such in the art. These may include but are not limited to:

a pipe storage area 109 for storing pipes, a storage area 116 for storing marine riser joints, one or more catwalk machines 108 or similar horizontal pipe handling equipment arranged to feed tubulars between one or more of the storage areas and the well centers, other storage areas below the drill floor deck configured for storing a variety of equipment, such as replacement parts, e.g. for mud pumps, etc., an accommodation superstructure 106.

A part of the main deck 115 of the vessel is located beneath the drill floor deck and allows heavy subsea equipment, e.g. a BOP 130 and a Christmas tree 103 to be moved to the moon pool under the well centers so as to allow such equipment to be lowered toward the seabed.

Figure 2A:
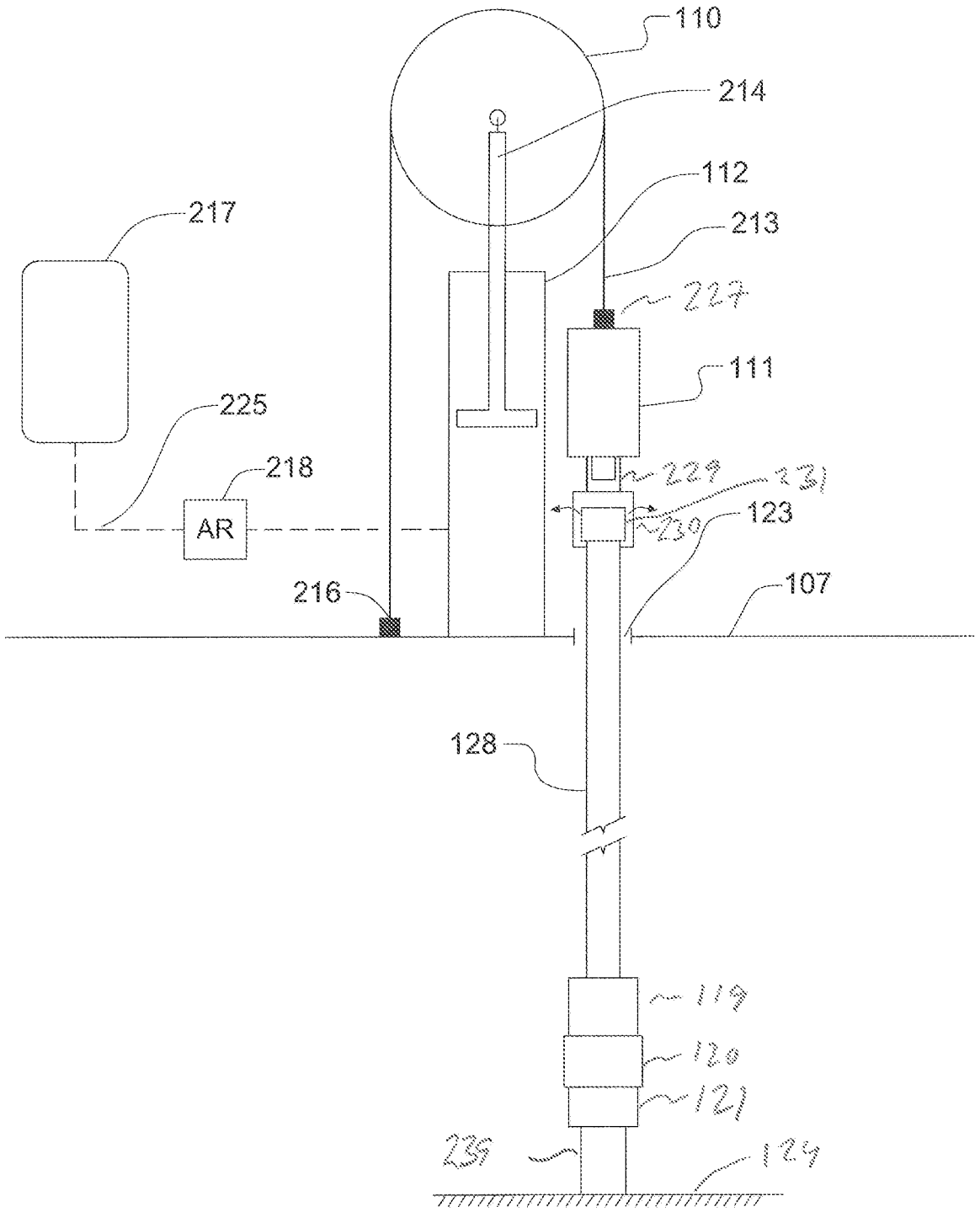
FIG. 2*a*-2*d* illustrates components of an embodiment of an offshore drilling rig with a hydraulic hoisting system.

FIG. 2*a* illustrates components of an embodiment of a drilling rig e.g. a drilling rig installed on the drilling vessel of FIG. 1. The drilling rig comprises a hydraulic hoisting system including a number of cylinders 112 that extend upwards relative to the drill floor deck 107. Each cylinder comprises a piston 214 whose free end is operationally coupled to a sheave 110 such that the sheave is raised when the piston is pushed out of the cylinder 112 and lowered when the piston retracts into the cylinder 112. In some embodiments, the hoisting system comprises two sets of hoisting cylinders, each set comprising one or more cylinders. A hoisting line 213 extends over the sheave 110 and carries a top drive 111 attached to a free end of the hoisting line 213. The hoisting line 213 has a dead end 216 that is anchored at the drill floor or at another suitable support structure of the drilling vessel. It will be appreciated that some embodiments may include a plurality of hoisting lines. The sheave and hoisting line transfer the force exerted by the hydraulic cylinders 112 to a lifting force acting on the top drive 111 and on a tubular string 128 suspended by the hoisting system, e.g. a completion riser string.

The top drive 111 may be directly connected to the hoisting line or connected to the hoisting line via a suitable load carrier such as a hook, a yoke, a dolly, and/or the like. The stroke of the cylinders causes upwards/downwards movement of the top drive which may be guided along a drilling support structure (not shown in FIG. 2*a*) via a dolly or another suitable guide system. The top drive is thus positioned between the hoisting line 213 and the tubular string 128 that is suspended by the hoisting system, and the top drive 111 is operable to move upwards and downwards above the drill floor 107. The top drive 111 provides lifting to the tubular string via a lifting frame 230 (such as a coil tubing lifting frame) connected to the top drive via bails 229. A surface flow tree 231 is connected to the tubular string 128 and the load of the tree 231 is supported by the frame 230. The frame 230 is not compensated and thus provides a direct mechanical connection between top drive 111 and the tubular string 128 as well as a direct mechanical connection between the hook 227 and the tubular string 128.

The tubular string 128 is a CWOR connected to an EDP 119, an LRP 120 and (a vertical) subsea xmas tree 121 mounted on the well head 239.

The drilling rig further comprises an anti-recoil valve 218 located in a hydraulic line 225 extending between a fluid reservoir 217 and the hoisting cylinder 112. During normal operation, the anti-recoil valve 218 is in an open state. When a sudden reduction of the load suspended from the hoisting system occurs, e.g. due to an emergency disconnected of a HP tubular string from a subsea tree of a completion work-over riser system, the anti-recoil valve 218 is activated. To this end, the drilling rig may comprise a control system operable to detect a sudden reduction of the suspended load to activate the anti-recoil valve. The control system may comprise one or more sensors operable to detect a sudden reduction of the load, e.g. by detecting the velocity of the piston 214, by detecting a change in the weight suspended from the hoisting system, or by another suitable sensor. Activation of the anti-recoil valve causes the anti-recoil valve to close the flow path 225 except for a residual flow that is still allowed to flow between the fluid reservoir 217 and the hoisting cylinder 112. This may cause the piston 214 to push upwards in a controlled fashion and thus lift the disconnected part of the HP tubular string (in this case the completion riser string 218) upwards so as to ensure that the disconnected part of the completion riser and any pipe or tubing extending though it comes free of any residual equipment at the seafloor from which the disconnected part has been disconnected. It will be appreciated that the hydraulic system for controlling the hoisting cylinders may comprise additional components not explicitly shown in FIG. 2*a*, such as pumps, valves further conduits, controls, etc. The fluid reservoir 217 may comprise one or more pressure vessels. The fluid reservoir may operate as a passive 'spring' so as to provide heave compensation by storing and dissipating the energy associated with wave motion. Alternatively or additionally, the fluid reservoir 217 may comprise a pressure charging module which may comprises additional high pressure storage or otherwise allow the pressure in the hoisting cylinder 112 to be actively adjusted when required, e.g. so as to raise or lower a tubular string.

Figure 2B:
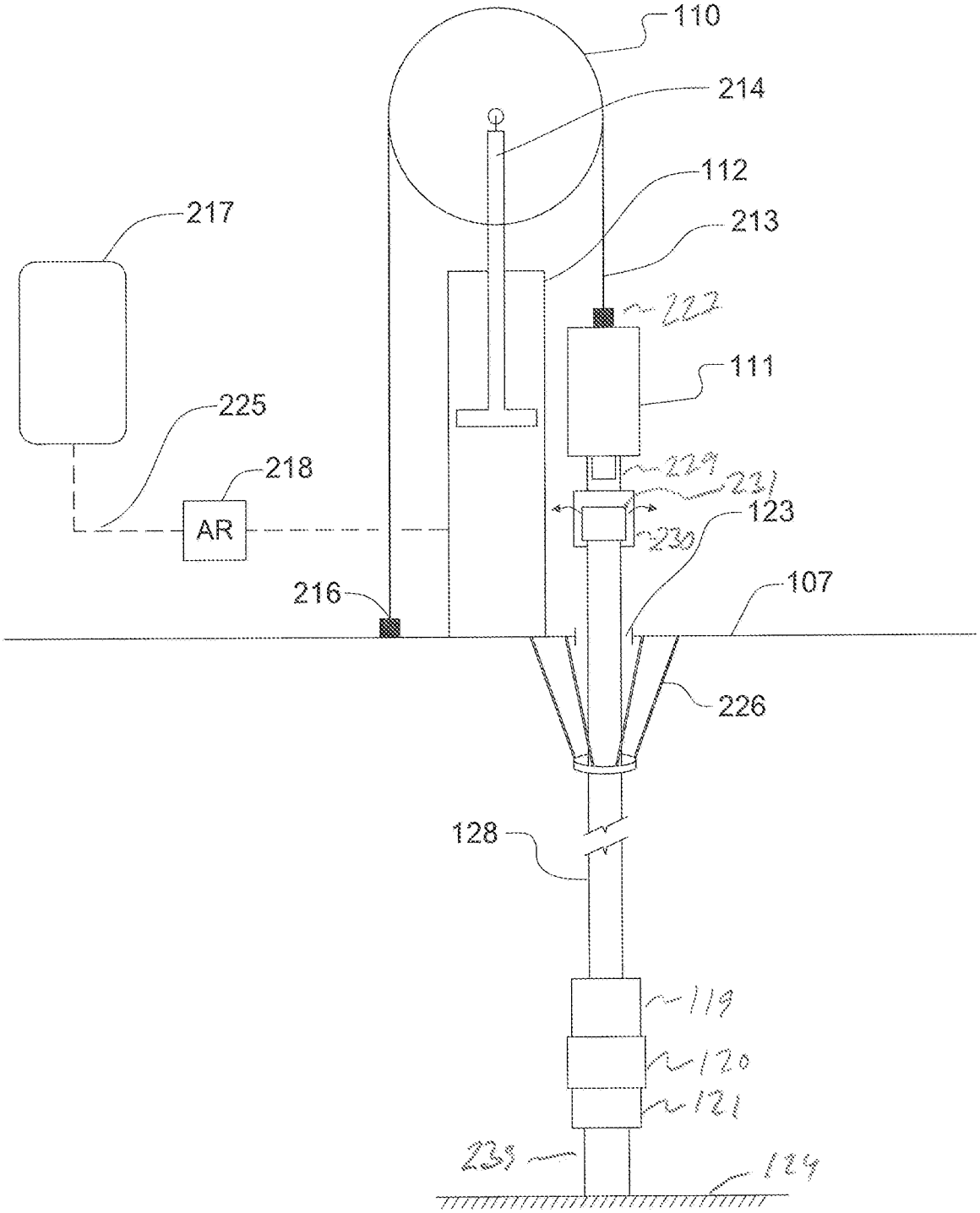

In FIG. 2*a* the hoisting system supports the apparent weight solely by the hoisting systems. FIG. 2*b* illustrates components of another embodiment of invention similar to that of FIG. 2*a* except in this case a set of riser tensioners 226 are applied to support part of the apparent weight of the CWOR. While this system may be more complex than that of FIG. 2*a* this system may still enjoy the omission of a compensating tension frame.

Figure 2C:
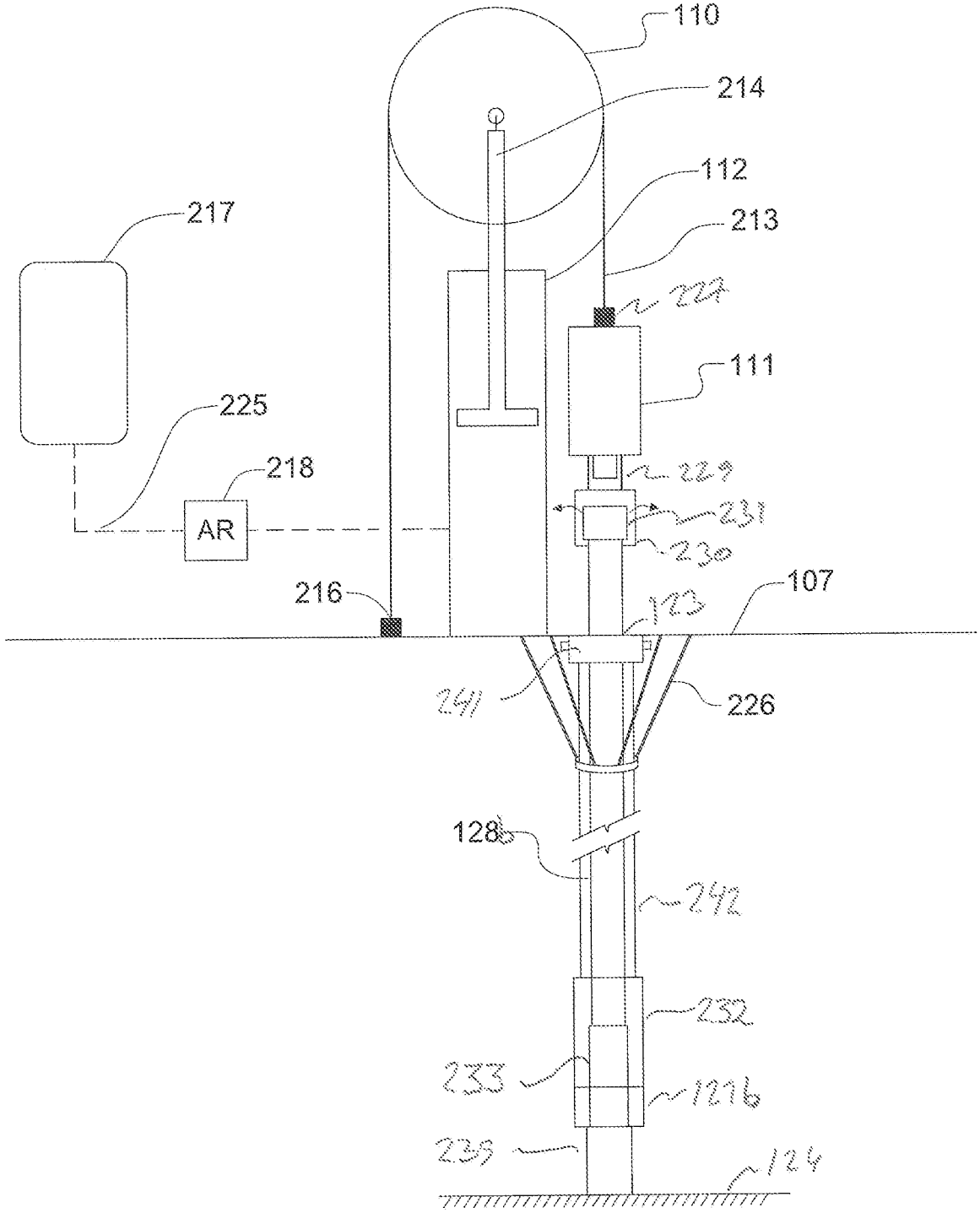

FIG. 2*c* illustrates components of another embodiment of invention similar to that of FIG. 2*a,b*. In this case the drilling rig is applied to perform a workover or completion operation via a horizontal xmas tree 121 *b* and the tubular string is a high pressure conduit 128*b*. The rig and the xmas tree 121 *b* are connected via the BOP 232 and the marine riser 242 up to the diverter 241. Tensioning for the marine riser is provide by the tensioners 226. The hoisting system supports the high pressure conduit 128*b* which is connected to the surface flow tree 231 similarly to FIG. 2*a,b* and to the subsea test tree 233 installed inside the BOP 233.

Figure 2D:
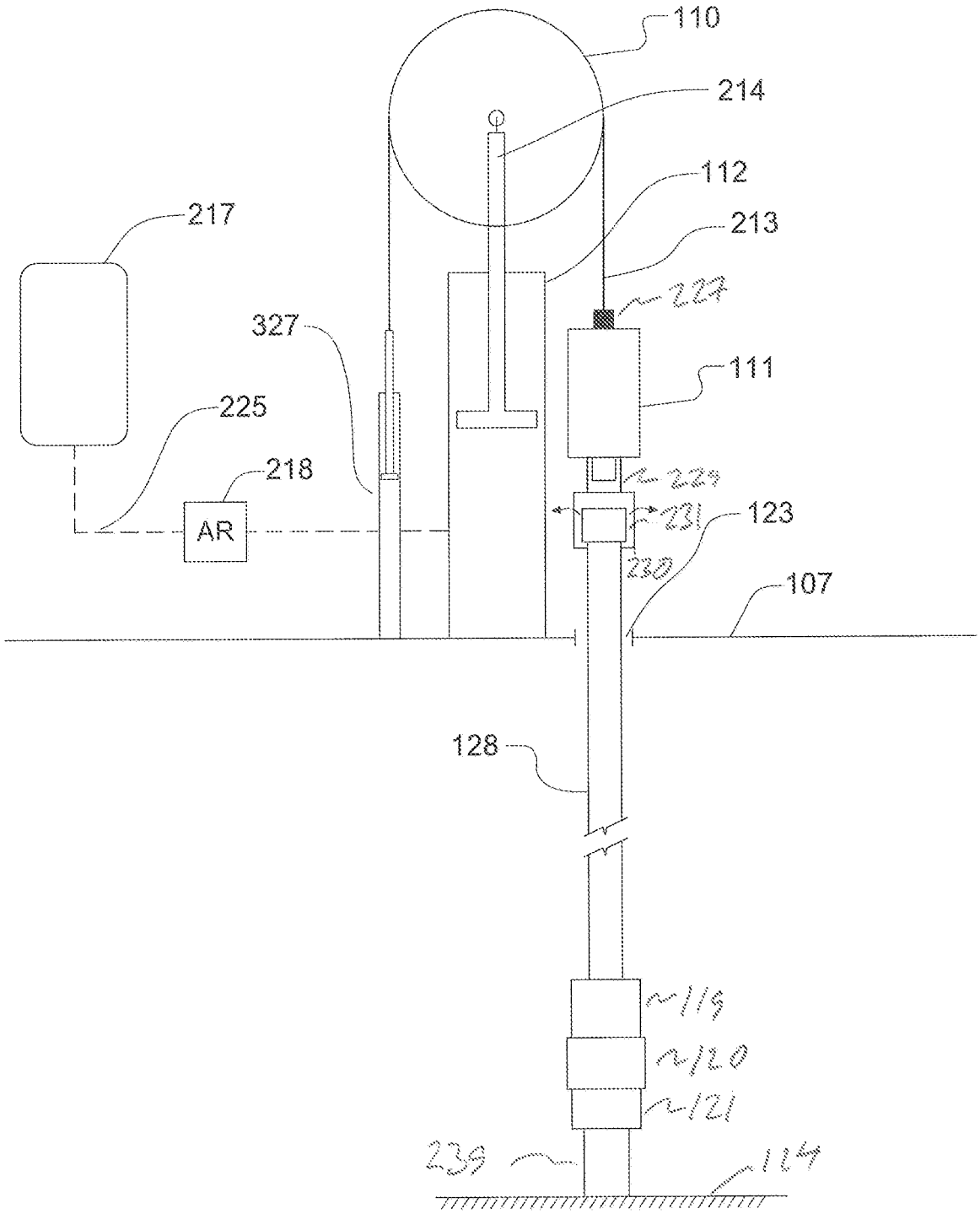

FIG. 2*d* illustrates components of another embodiment of a drilling rig. The drilling rig of FIG. 2*d* is similar to the one of FIG. 2*a-c* and comprises a hydraulic hoisting system including a number of cylinders 112, a top drive 111, a sheave 110, a hoisting line 213, and a drill floor 107 defining a well center 123, all as described in connection with FIG. 2*a-c*. While not shown, the drilling rig of FIG. 2*d* may also be applied using riser tensioners as in FIG. 2*b* or a marine riser as in FIG. 2*c*.

The drilling rig of FIG. 2*d* differs from the drilling rig of FIG. 2*a-c* in that the dead end of the hoisting line 213 is connected to the drill floor or another suitable support structure of the drilling rig via one or more heave-compensating hydraulic cylinders 327. Heave compensation via cylinder 327 may be performed as active or passive heave compensation or as a combination thereof. To this end the heave-compensating cylinder 327 is in fluid communication with a fluid reservoir 217 via flow path 225.

The drilling rig further comprises an anti-recoil valve 218 located in hydraulic line 225 extending between fluid reservoir 217 and the heave-compensating cylinder 327. During normal operation, the anti-recoil valve 218 is in an open state. When a sudden reduction of the load suspended from the hoisting system occurs, e.g. due to an emergency disconnected of a HP tubular string from a subsea tree of a completion work-over riser system, the anti-recoil valve 218 is activated as described in connection with FIG. 2*a-c*. As in the example of FIG. 2*a-c*, it will be appreciated that the hydraulic system for controlling the hoisting cylinders may comprise additional components, such as pumps, valves further conduits, controls, etc.

Figure 3A:
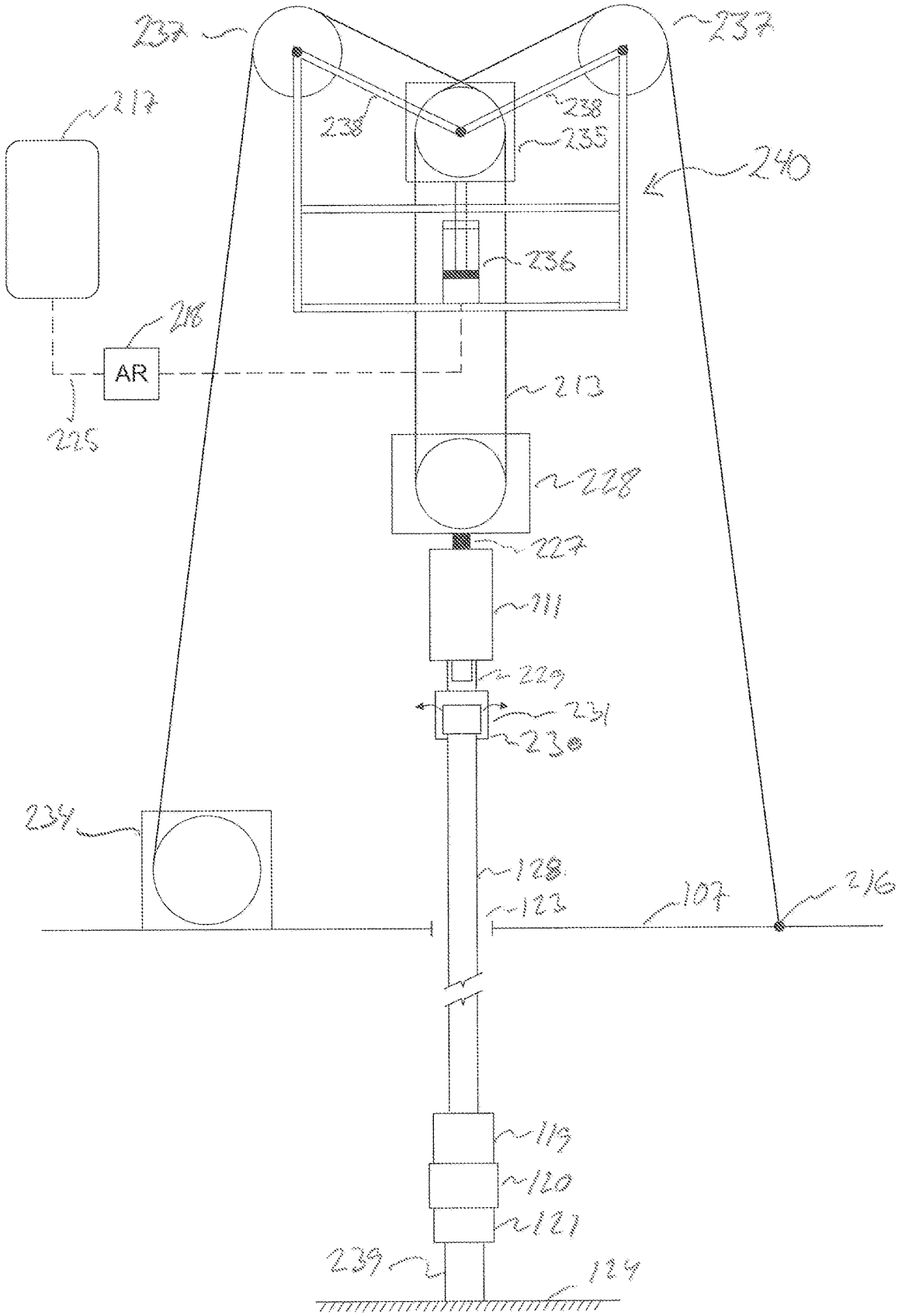
FIG. 3*a*-3*c* illustrates components of another embodiment of an offshore drilling rig with a draw works hoisting system.
Figure 3B:
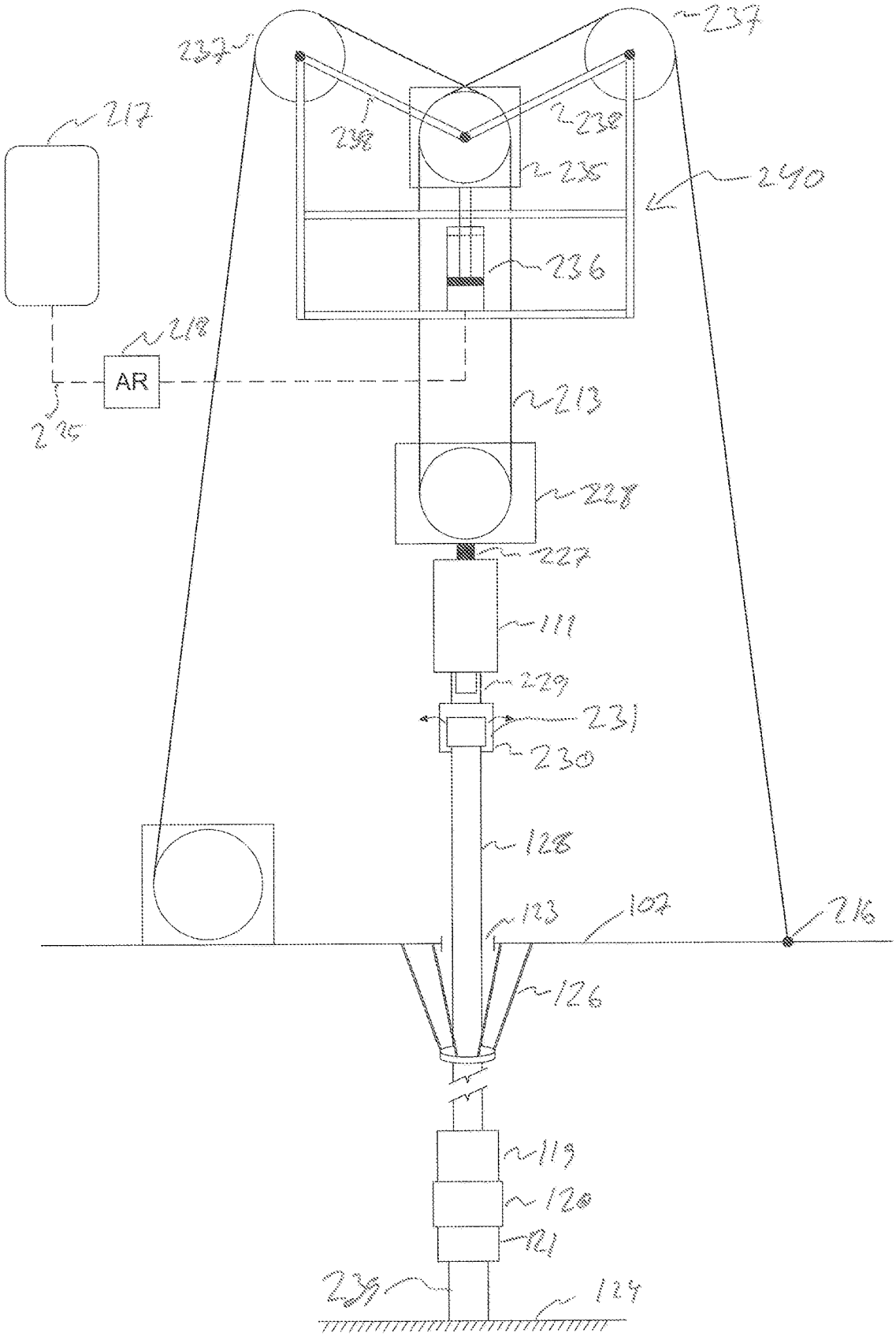
Figure 3C:
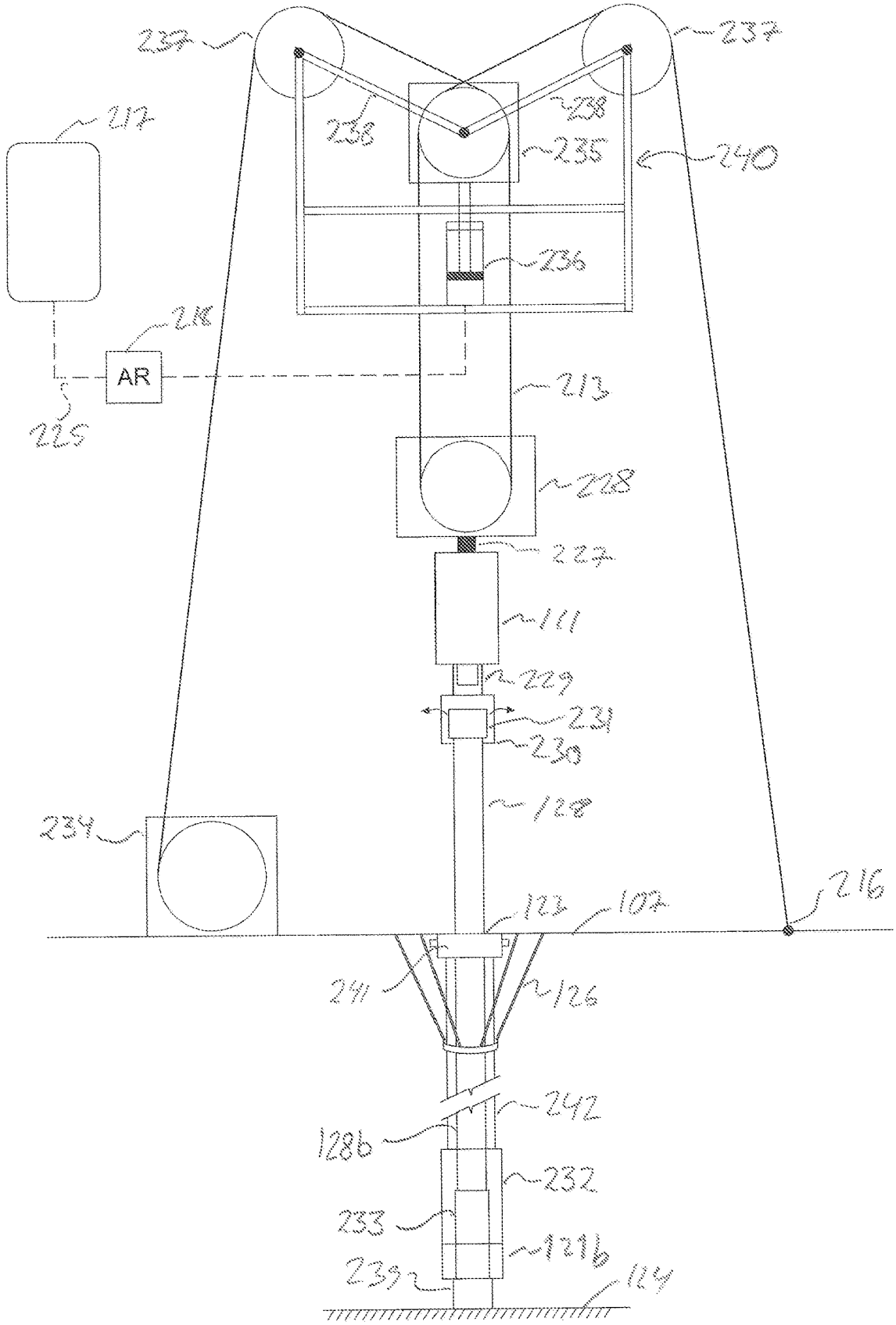

Hence, in the examples of FIGS. 2 and 3, the anti-recoil valve is integrated in the main hydraulic hoisting system or in the heave-compensation system associated with the main hoisting system. In both examples, the anti-recoil system controls the lifting force acting above the top drive or even above the hook and applied to the top drive and the tubular string. In both systems, the main hoisting system and, optionally the integrated heave compensation system, carries the entire apparent weight of the top drive and of the HP tubular string and any subsea equipment attached thereto.

FIG. 3*a,b,c* illustrates components of another embodiment of a drilling rig with a draw works hoisting system but otherwise similar to the embodiments and applications shown in FIGS. 2*a*, 2*b*, and 2*c*, respectively. The differences are explained in the following. As on most conventional offshore drilling rig, a draw work 234 supply the active power for controlling the hoisting line 213. The line runs to the crown block 235 and is reeved between it and the travelling block 228. The line proceeds to the dead line anchor 216. The travelling block supports the hook 227 and the top drive 111. A crown compensator with a crown compensator assembly 240 is installed to allow heave compensation of the hook. The crown compensating cylinder 236 is arranged so that the height of the crown block may be varied. Here is shown an exemplary crown compensator which further comprises guide sheaves 237 guiding the hoisting line to the crown block as well as two guide arms 238 guiding the motion of the crown block. The crown block and crown compensator assembly are supported by a four legged derrick (not shown) and the top drive is supported by a dolly (not shown) as discussed in relation to FIG. 2. An anti-recoil system similar to that of FIG. 2 is installed but now connected to the crown compensating cylinder. In the event of a sudden loss in tension the anti-recoil may stroke out the cylinder 236 sufficiently and controlled to provide sufficient lifting of the tubular string without damaging the drilling rig.

Accordingly, in embodiments where the drilling rig further comprises a riser tensioner system 226 operable to support and provide tension to a marine riser during drilling operations, such a riser tensioner system may be brought into a passive state during well completion and/or intervention operations where a completion riser string is employed instead. To this end the riser tensioner system may be moved into a parking position laterally displaced from the well center, e.g. by means of a trip saver. The riser tensioner system 226 of a drilling rig is typically dimensioned so as to be used in conjunction with a marine riser string. Marine risers are typically heavier and have a larger diameter than the completion riser joints used as part of a completion work-over riser system. For example, while typical marine riser joints have a diameter of 50-60 inches, riser joints of a completion work-over riser typically have a diameter smaller than 50 inches, such as smaller than 30 inches, such as between 8 inches and 14 inches.

Even though the above embodiments have been described in the context of a drillship, it will be appreciated that the described features may also be implemented in the context of a semi-submersible or other type of drilling vessel.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention. For example, some of the described embodiments comprise two well centers, but it will be appreciated that alternative embodiments may comprise a single well center or a well center and additional work centers.

In the device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof

What is claimed is:

1. An offshore drilling rig comprising:

a drill floor defining a well center;

a hoisting system configured to advance a tubular string downwards through the well center and to the seafloor and to apply a lifting force to a tubular string extending through the well center and to the seafloor, wherein the hoisting system is a hydraulic hoisting system comprising one or more hydraulic hoisting cylinders; and an anti-recoil system configured to cause, in case of a sudden reduction of a load suspended from the drilling rig, the hoisting system to raise the tubular string in a controlled fashion;

wherein the anti-recoil system is operationally connected to the one or more hydraulic hoisting cylinders.

2. The offshore drilling rig according to claim 1 wherein the anti-recoil system comprises a fluid reservoir and an anti-recoil valve, the anti-recoil valve being adapted for connecting the one or more hydraulic hoisting cylinders to the fluid reservoir.

3. The offshore drilling rig according to claim 2 and further comprising a control system being adapted:

to detect a sudden reduction of a load suspended from the drilling rig, and to activate the anti-recoil valve when a sudden reduction of a load suspended has been detected.

4. The offshore drilling rig according to claim 3 wherein the anti-recoil valve during normal operation is open and connects the one or more hydraulic hoisting cylinders to the fluid reservoir, and wherein activation of the anti-recoil valve causes the anti-recoil valve to close the flow path except for a residual flow that is still allowed to flow between the fluid reservoir and the one or more hydraulic hoisting cylinders.

5. The offshore drilling rig according to claim 2 wherein the anti-recoil valve during normal operation is open and connects the one or more hydraulic hoisting cylinders to the fluid reservoir, and wherein activation of the anti-recoil valve causes the anti-recoil valve to close the flow path except for a residual flow that is still allowed to flow between the fluid reservoir and the one or more hydraulic hoisting cylinders.

6. The offshore drilling rig according to claim 1 the lifting force being large enough to support at least at least a majority part of an apparent weight of the tubular string.

7. The offshore drilling rig according to claim 1 wherein the tubular string is a Completion Work-Over Riser (CWOR) system connected to a vertical xmas tree or a high-pressure conduit connected to a subsea test tree.

8. The offshore drilling rig according to claim 1, wherein the hoisting system is a draw works hoisting system comprising a crown compensator comprising one or more crown compensating hydraulic cylinders, and wherein the anti-recoil system is operationally connected to the one or more crown compensating hydraulic cylinders.

9. The offshore drilling rig according to claim 8 wherein the anti-recoil system comprises an anti-recoil valve and a fluid reservoir fluidly connected via the anti-recoil valve to the one or more crown compensating hydraulic cylinders.

10. The offshore drilling rig according to claim 1 wherein the anti-recoil system comprises an anti-recoil valve and a fluid reservoir fluidly connected via the anti-recoil valve to the one or more hydraulic hoisting cylinders.

11. The offshore drilling rig according to claim 1 wherein the hydraulic hoisting system comprises a sheave movably supported by the one or more hydraulic hoisting cylinders, and a hoisting line extending over the sheave;

the hoisting line having a dead end;

wherein the dead end is connected to a support structure of the drilling rig via one or more heave-compensating hydraulic cylinders; and wherein the anti-recoil system is operationally connected to the one or more heave-compensating hydraulic cylinders.

12. The offshore drilling rig according to claim 11 wherein the anti-recoil system comprises an anti-recoil valve and a fluid reservoir fluidly connected via the anti-recoil valve to the one or more heave-compensating hydraulic cylinders.

13. The offshore drilling rig according claim 1 wherein the hoisting system comprises a hoisting line and hook arranged to lift loads suspended by the hoisting system via the hoisting line; and wherein the anti-recoil system is configured to control a lifting force acting above the hook.

14. The offshore drilling rig according to claim 13 wherein the drilling rig is operable to perform well control and/or intervention operations with the hook in direct mechanical connection to a Completion Work-Over Riser (CWOR) system or a high-pressure conduit.

15. The offshore drilling rig according to claim 1 comprising a top drive suspended above the drill floor by the hoisting system and configured to impart torque onto a tubular string extending through the well center and suspended by the hoisting system; and wherein the anti-recoil system is configured to control a lifting force acting above the top drive.

16. The offshore drilling rig according to claim 1 wherein the anti-recoil system is arranged to cause the hoisting system to raise the tubular string a height between 1 m and 15 m.

17. The offshore drilling rig according to claim 1 comprising a riser tensioner system wherein the drilling rig is operable to perform well completion and/or intervention operations with a Completion Work-Over Riser (CWOR) system suspended from the hoisting system and with the riser tensioner system disconnected from the Completion Work-Over Riser (CWOR) system.

18. The offshore drilling rig according to claim 1 comprising a riser tensioner system and a trip saver system operable to move the riser tensioner system between an operational position aligned with the well center and a parking position displaced from well center; wherein the drilling rig is operable to perform well completion and/or intervention operations with a Completion Work-Over Riser (CWOR) system suspended from the hoisting system and with the riser tensioner system positioned in the parking position.

19. The offshore drilling rig according to claim 1, wherein the anti-recoil system is configured to be selectively operable in an anti-recoil mode and an immediate shut-off mode;

wherein the anti-recoil system is configured, when operated in the anti-recoil mode, to cause, in case of a sudden reduction of a load suspended from the drilling rig, the hoisting system to raise the tubular string while preventing uncontrolled upwards recoil of the tubular string; and when operated in the immediate shut-off mode, to cause, in case of a sudden reduction of a load suspended from the drilling rig, the hoisting system to substantially prevent any upwards recoil of the tubular string.

20. A method of operating an offshore drilling rig, the drilling rig comprising a drill floor defining a well center, a hoisting system configured to raise and/or lower a tubular string through the well center, and an anti-recoil system configured to cause, in case of a sudden reduction of a load suspended from the drilling rig, the hoisting system to raise the tubular string while preventing damage to the hoisting system; wherein the method comprises:

suspending, from the hoisting system, a high-pressure tubular string extending through the well center and downwards to the seafloor;

detecting a sudden reduction of a load suspended from the hoisting system;

controlling the hoisting system to raise high pressure tubular string while preventing damage to the hoisting system;

wherein the high-pressure tubular string, when sudden reduction of the suspended load is detected, is raised by controlling fluid flow between a fluid reservoir of the anti-recoil system and the one or more hydraulic hoisting cylinders of the hoisting system.

21. The method of claim 20, wherein high-pressure tubular string is a Completion Work-Over Riser (CWOR) system, and wherein the method further comprises suspending at least a majority part of the apparent weight of a Completion Work-Over Riser (CWOR) system from the hoisting system.

* * * * *